US011661804B1

(12) United States Patent
Steffenhagen et al.

(10) Patent No.: US 11,661,804 B1
(45) Date of Patent: May 30, 2023

(54) COILED TUBING INJECTOR WITH REACTIVE CHAIN TENSION

(71) Applicant: NATIONAL OILWELL VARCO, L.P., Houston, TX (US)

(72) Inventors: Timothy Scott Steffenhagen, Fort Worth, TX (US); Matthew Stephen Lane, Fort Worth, TX (US)

(73) Assignee: NATIONAL OILWELL VARCO, L.P., Houston, TX (US)

( * ) Notice: Subject to any disclaimer, the term of this patent is extended or adjusted under 35 U.S.C. 154(b) by 0 days.

(21) Appl. No.: 17/821,538

(22) Filed: Aug. 23, 2022

(51) Int. Cl.
*E21B 19/22* (2006.01)
*E21B 19/10* (2006.01)

(52) U.S. Cl.
CPC ..... *E21B 19/22* (2013.01); *E21B 19/10* (2013.01)

(58) Field of Classification Search
CPC ..... E21B 19/22
See application file for complete search history.

(56) References Cited

U.S. PATENT DOCUMENTS

| | | | | |
|---|---|---|---|---|
| 5,309,990 | A | 5/1994 | Lance | |
| 5,918,671 | A | 7/1999 | Bridges et al. | |
| 8,544,536 | B2 | 10/2013 | Mcculloch et al. | |
| 8,701,754 | B2 | 4/2014 | Mcculloch | |
| 10,024,123 | B2 | 7/2018 | Steffenhagen et al. | |
| 2012/0247787 | A1* | 10/2012 | Lancaster | E21B 19/22 166/381 |

* cited by examiner

*Primary Examiner* — Matthew R Buck
(74) *Attorney, Agent, or Firm* — Schwegman Lundberg & Woessner, P.A.

(57) ABSTRACT

A coiled tubing injector including two or more drive chains each carrying a plurality of grippers for engaging coiled tubing within a grip zone defined between the two or more drive chains, a drive system including at least one hydraulic motor connected to a drive line and a return line forming a drive circuit for fluidly powering the at least one hydraulic motor, and a tension system including at least one hydraulic cylinder for tensioning the two or more drive chains. The tension system can include a reactive chain tension circuit for automatically tensioning the two or more drive chains by maintaining a pressure differential between a fluid pressure within the drive line and a fluid pressure within the at least one hydraulic cylinder.

20 Claims, 7 Drawing Sheets

COILED TUBING INJECTOR WITH REACTIVE CHAIN TENSION

TECHNICAL FIELD

The present disclosure pertains generally, but not by way of limitation, to coiled tubing injectors for driving continuous tubing into well bores. More particularly, but not by way of limitation, the present disclosure pertains to systems and methods for tensioning drive chains within coiled tubing injectors.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Coiled tubing refers generally to continuous tubing coiled on a reel or spool. Coiled tubing is significantly faster, relative to conventional interconnected rigid piping, to trip into wellbores or trip out of wellbores. Additionally, coiled tubing can function as either temporary or permanent piping in production wells. As such, coiled tubing is commonly used in both drilling and workover operations at well sites. Coiled tubing injectors are devices for inserting coiled tubing into, and withdrawing coiled tubing from, wellbores. When in use, coiled tubing injectors are typically situated directly above a wellbore; and can position the coiled tubing within the wellbore by precisely controlling the rate at which the coiled tubing moves through die coiled tubing injector. For example, many coiled tubing injectors include a pair of counter-rotating drive chains each carrying grippers which continuously engage the coiled tubing within a "grip-zone" (e.g., an area in which the grippers are in contact with the coiled tubing) defined between the drive chains.

The drive chains are often rotated by one or more hydraulic motors fluidly powered by an external power unit, such as a hydraulic power pack. While tripping the coiled tubing into a wellbore, the coiled tubing is generally in a "pipe-heavy" state, in that the downward force of gravity acting on the coiled tubing is greater than any upward force acting on the coiled tubing. When the coiled tubing is pipe-heavy, the coiled tubing injector can function to control the rate at which the coiled tubing passes through the grip zone by resisting the downward force of gravity acting on the coiled tubing. As can be appreciated, a portion of each drive chain within the grip zone will be placed under constant tension when the grippers begin supporting the weight of the coiled tubing. While tripping the coiled tubing into a wellbore, the coiled tubing may switch from a pipe-heavy state to a pipe-light state, in that the downward force of gravity acting on the coiled tubing is less than an upward force acting on the coiled tubing caused by pressure within a wellbore. For example, the coiled tubing can switch from a pipe-heavy state to a pipe-light state, such as due to an obstruction located within the wellbore, internal pressure within the wellbore, or other factors.

When the coiled tubing becomes pipe-light, such as in response to an obstruction or internal pressure within the wellbore, the coiled tubing injector must function to push the coiled tubing into the wellbore by applying a downward, or "snubbing", force sufficient to overcome the pressure within the wellbore. However, such an upward force will act on the coiled tubing injector in a direction opposite to the downward movement of the grippers carried by the drive chains. As can be appreciated, this can cause a portion of each drive chain passing through the grip zone to lose tension and rapidly become slack or "bunch up", such as in an area near the drive sprockets responsible for supporting and turning the drive chains. Chain bunching can cause serious damage to the coiled tubing, the drive chains, the driven sprockets, the grippers, or other components of the coiled tubing injector. Such damage can be costly to repair, and the downtime associated with repair or replacement of the coiled tubing injector can significantly lengthen a well drilling or workover operation.

To help avoid the above issues, coiled tubing injectors often include a chain tension system operable to adjustably tension the drive chains. For example, a user can increase tension within the drive chains from a preset level to a predetermined level above the preset level if the coiled tubing switches from a pipe-heavy state to a pipe-light state, such as to prevent the drive chains from becoming vulnerable to chain bunching. Subsequently, if the tubing switches back to a pipe-heavy state, the user can proportionally reduce the tension within the drive chains. However, existing chain tension systems require a user to closely monitor a tubing load on the coiled tubing injector, such as to proactively predict necessary tension within the drive chains. The tubing load can be a positive load (e.g., the downward force applied to the injector by the coiled tubing) or a negative load (e.g., the upward force applied to the injector by the coiled tubing); and can change frequently during continuous operation of the coiled tubing injector. For example, if the coiled tubing encounters an obstruction within a wellbore, the tubing load can rapidly and unexpectedly switch from a positive load to a negative load.

As such, existing chain tension systems are susceptible to user error. For example, a user can fail to notice that a negative tubing load has arisen, such as indicating the coiled tubing has switched from a pipe-heavy state to pipe-light state; and will therefore also fail to proportionally increase the tension in the drive chains. As a result, the drive chains are likely to begin bunching. Similarly, a user can fail to notice that a positive tubing load has arisen, such as indicating that the coiled tubing has switched back from a pipe-light state to a pipe-heavy state; and will therefore also fail to proportionally decrease the tension in the drive chains. As a result, the drive chains, the drive sprockets, chain guides, and many other components of the coiled tubing injector are likely to prematurely degrade due to excessive and unnecessary tension present within the drive chains. For example, when the drive chains are tensioned for pipe-light operating conditions, outer-facing portions of the drive sprockets, and outer facing portions of idler sprockets helping to guide or support the drive chains, can be under a significant tension force.

SUMMARY

In a non-limiting example, a coiled tubing injector can include: two or more drive chains each forming a continuous loop and carrying a plurality of grippers for engaging coiled tubing within a grip zone defined between the two or more drive chains: a drive system including: a first drive sprocket engaged with a first drive chain of the two or more drive chains; a second drive sprocket engaged with a second drive chain of the two or more drive chains; at least one hydraulic motor for turning the first drive sprocket and the second drive sprocket, the at least one hydraulic motor connected to a drive line and a return line forming a drive circuit for fluidly powering the at least one hydraulic motor; and a tension system including: at least one hydraulic cylinder for tensioning the two or more drive chains; and a reactive chain tension circuit for automatically tensioning the two or more drive chains by maintaining a pressure differential between a fluid pressure within the drive line and a fluid pressure within the at least one hydraulic cylinder.

In another non-limiting example, a coiled tubing injector can include: two or more drive chains each forming a continuous loop and carrying a plurality of grippers for engaging coiled tubing within a grip zone defined between the two or more drive chains; a drive system including: a first drive sprocket engaged with a first drive chain of the two or more drive chains; a second drive sprocket engaged with a second drive chain of the two or more drive chains; a first hydraulic motor for turning the first drive sprocket; a second hydraulic motor for turning the second drive sprocket, wherein the first hydraulic motor and the second hydraulic motor are connected in parallel to a drive line and a return line forming a drive circuit for fluidly powering the first hydraulic motor and the second hydraulic motor; and a tension system including: one or more first hydraulic cylinders for tensioning the first drive chain, a second hydraulic cylinder for tensioning the second drive chain; and a reactive chain tension circuit for automatically tensioning the first drive chain and the second drive chain by maintaining a pressure differential between a fluid pressure within the drive line and a fluid pressure within the one or more first hydraulic cylinders and the one or more second hydraulic cylinders, wherein the reactive chain tension circuit is connected to a first port of the first hydraulic motor via a pilot line to provide the reactive chain tension circuit with a pressure signal indicative of a tubing load on the coiled tubing injector.

In an additional example, a method of using a coiled tubing injector including two or more drive chains carrying a plurality of grippers for engaging coiled tubing within a grip zone defined between a first drive chain and a second drive chain, and a drive system for turning the two or more drive chains and including at least one hydraulic motor connected to a drive line for fluidly powering the at least one hydraulic motor, can include activating the drive system to begin moving the coiled tubing through the grip zone toward a wellbore; and tensioning the two or more drive chains by a reactive chain tension circuit based on a fluid pressure within the at least one hydraulic motor, by maintaining a pressure differential between the fluid pressure within the at least one hydraulic motor and a fluid pressure within at least one hydraulic cylinder for tensioning the first drive chain and the second drive chain.

Figure 1:
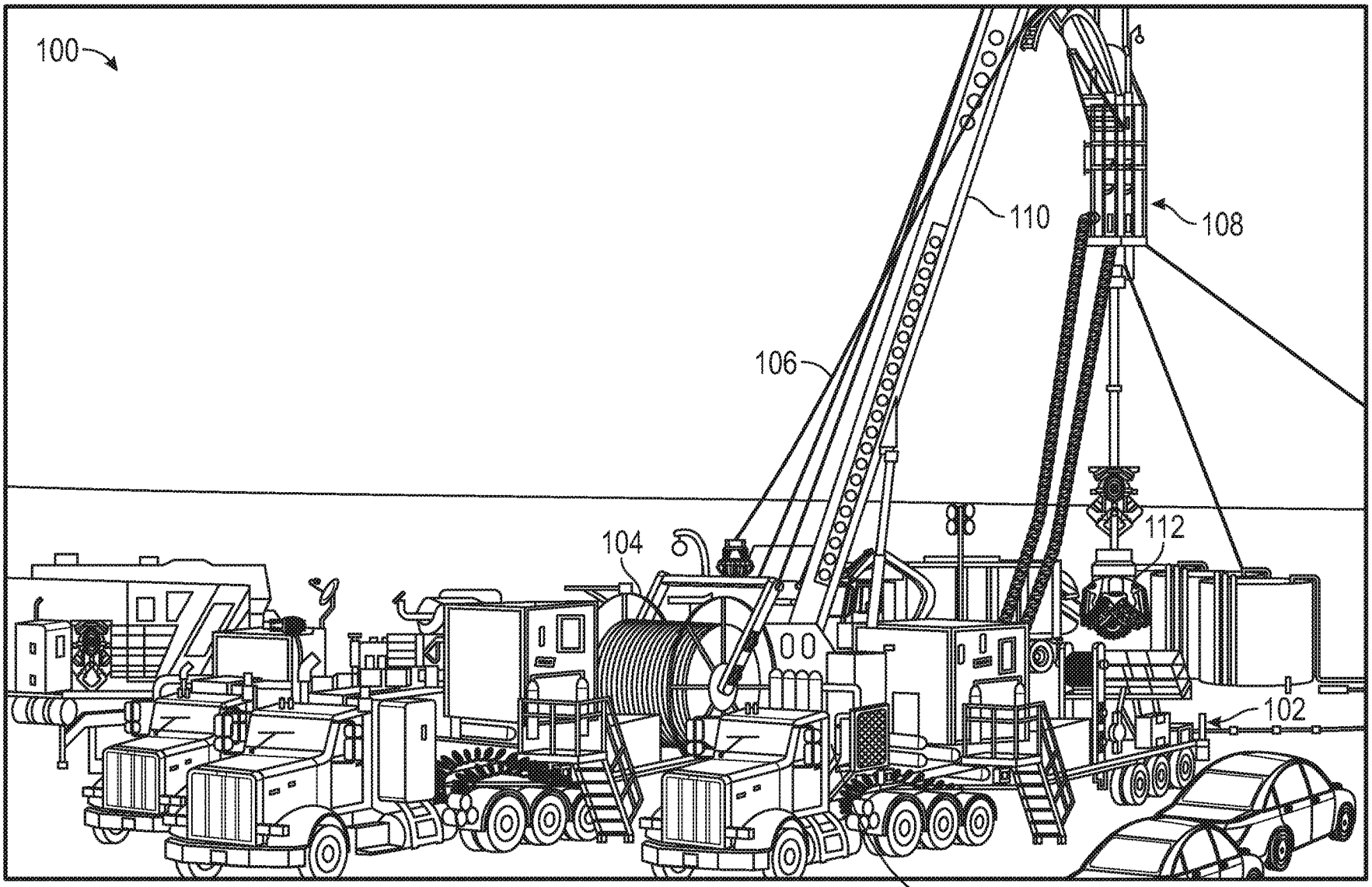
FIG. 1 illustrates a perspective view of a coiled tubing unit in place on a well pad, according to one or more examples.

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

The coiled tubing injector of the present disclosure can help to address the above issues, among others, such as by providing a tension system capable of automatically tensioning the drive chains of a coiled tubing injector in proportion to a positive tubing load or a negative tubing load acting on the coiled tubing injector. For example, the tension system can include a reactive chain tension circuit configured to maintain a pressure differential between a fluid pressure within one or more hydraulic motors for turning the drive chains and a fluid pressure within one or more hydraulic cylinders for tensioning the drive chains. In such an example, the reactive tension circuit can receive a pressure signal from the one or more hydraulic motors to adjust the fluid pressure within the one or more hydraulic cylinders, such as in response to an increasing negative load on the one or more hydraulic motors and fall in proportion to a decreasing negative load on the one or more hydraulic motors, such as to ensure the drive chains are under constant tension sufficient to prevent chain bunching in pipe-light operation conditions.

In view of the above, the reactive chain tension circuit can make operating coiled tubing injectors easier for a user while preventing coiled tubing injectors from becoming susceptible to drive chain bunching. For example, rather than closely monitoring the tubing load and operate a chain tension system, the user can be free to devote attention to other aspects of drilling or workovers operations at a well site. Additionally, the reactive chain tension circuit can improve the reliability and overall service life of coiled tubing injectors. For example, as the reactive chain tension circuit can automatically decrease tension within the drive chains as the tubing load decreases, the reactive chain tension circuit can prevent any unnecessary wear of the drive chains, drive sprockets, chain guides, or other components of coiled tubing injectors. Further, the reactive chain tension circuit can help to reduce the overall cost of various operations at well sites. For example, by preventing a user from tensioning the drive chains above a level necessary to prevent chain bunching, the reactive chain tension circuit can reduce the likelihood of operational downtime caused by repair or replacement of a coiled tubing injector.

FIG. 1 illustrates a perspective view of a coiled tubing system 100 in place on a well pad 102, according to one or more embodiments. As shown in FIG. 1, the coiled tubing system 100 can include a tubing spool 104 containing a high linear footage of coiled tubing 106. The coiled tubing system 100 can include a coiled tubing injector 108. The coiled tubing injector 108 can be operable to advance the coiled tubing 106 into, or withdraw the coiled tubing 106 from, a wellbore of the well pad 102.

In one example, such as shown in FIG. 1, the coiled tubing injector 108 can be suspended above a well bore by a crane 110, such as to help enable the coiled tubing injector 108 to pull the coiled tubing 106 from the tubing spool 104 and lower the coiled tubing 106 into a wellbore. In some examples, the coiled tubing 106 can be connected to various attachments, such as a drilling assembly 112. In such an example, the coiled tubing 106 can be connected to a drilling fluid source on the well pad 102 to fluidly power the drilling assembly 112 during a well bore drilling operation. The coiled tubing system 100 can include a hydraulic power unit, such as, but not limited to, a power pack 113. The power pack 113 can be connected to the coiled tubing injector 108 to fluidly power the coiled tubing injector 108.

Figure 2:
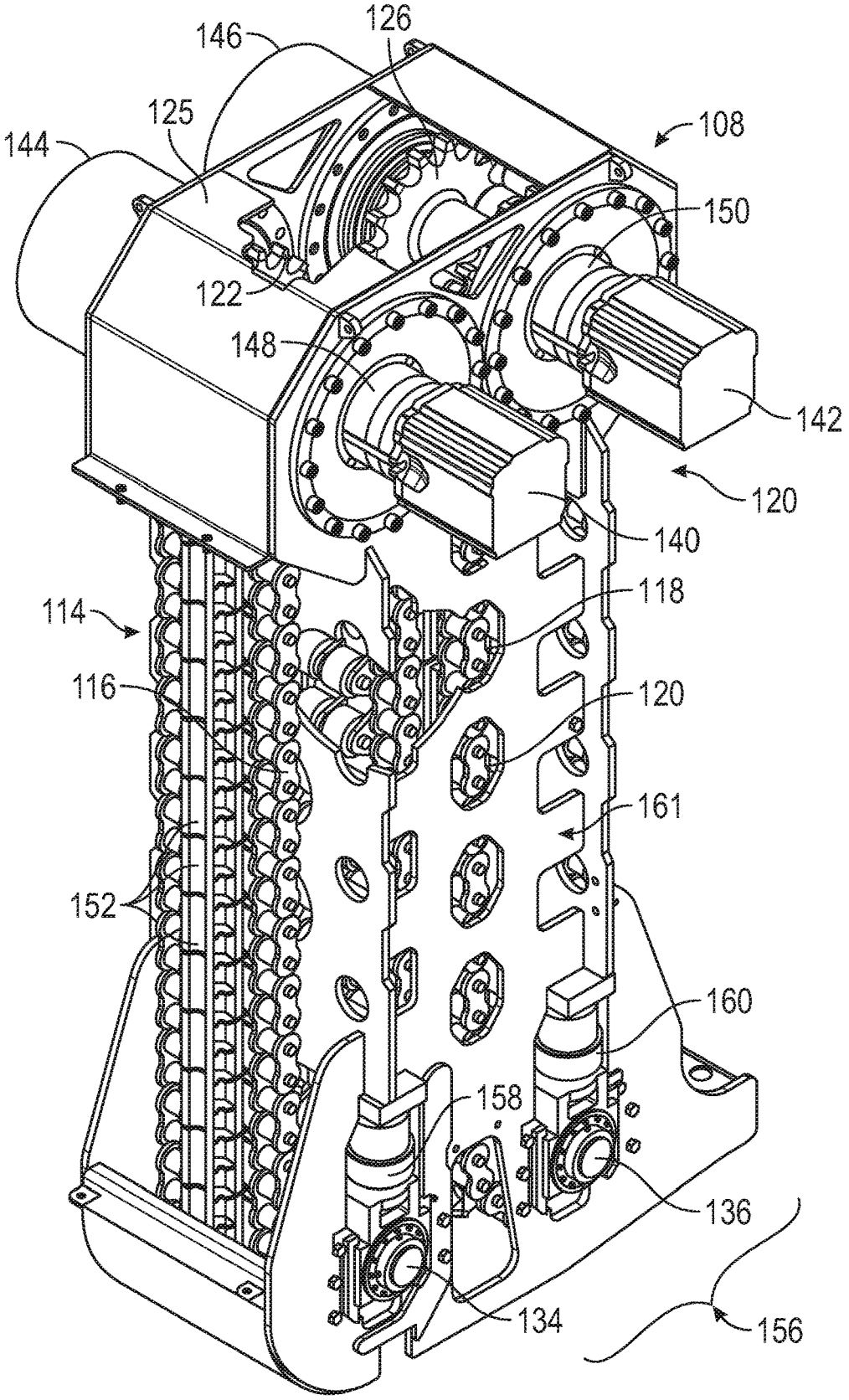
FIG. 2 illustrates an isometric view of the coiled tubing injector of FIG. 1, according to one or examples.
Figure 3:
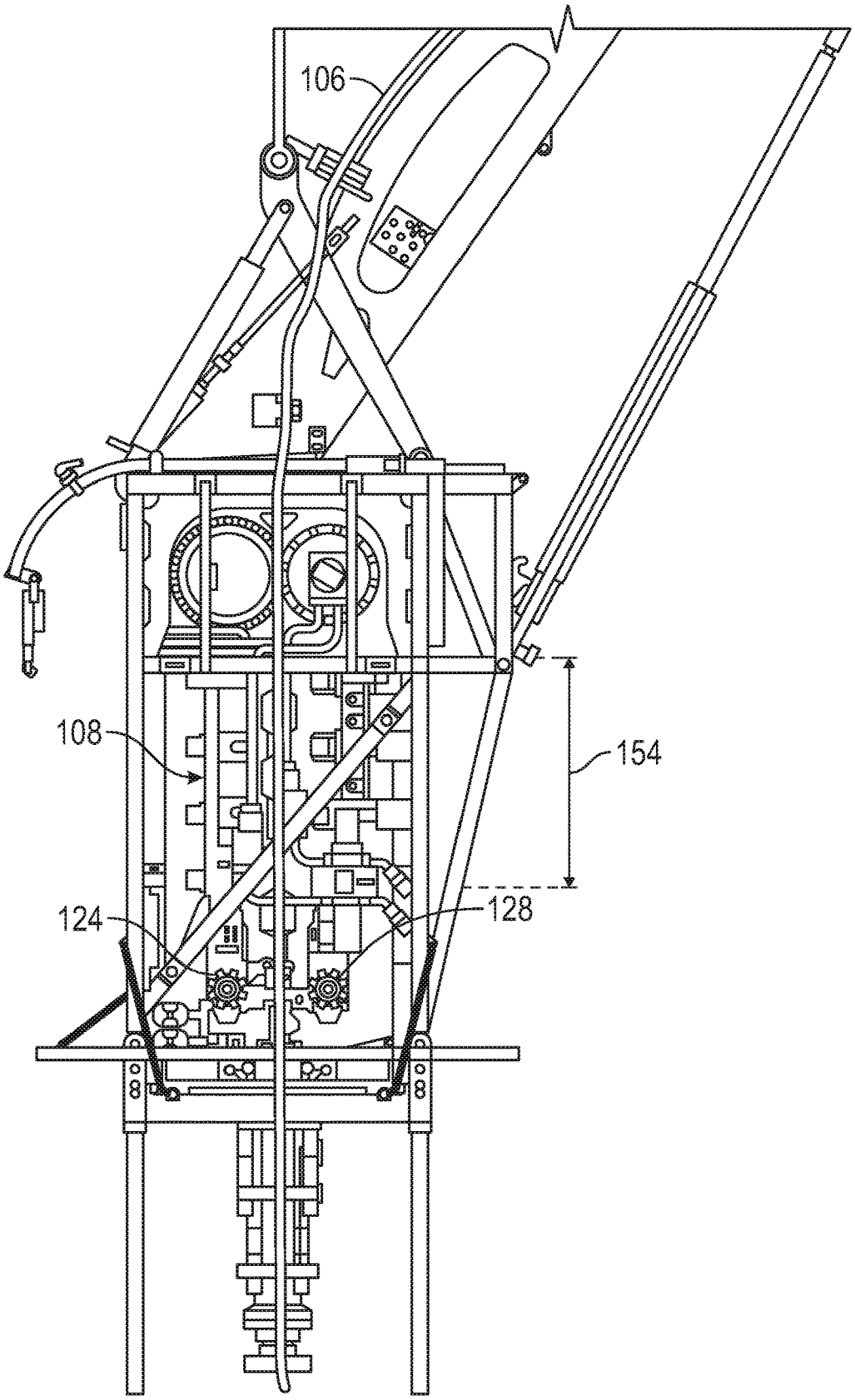
FIG. 3 illustrates a side view of the coiled tubing injector of FIGS. 1-2, according to one or more examples.

FIG. 2 illustrates an isometric view of the coiled tubing injector 108 of FIG. 1, according to one or more embodiments. FIG. 3 illustrates a side view of the coiled tubing injector 108 of FIGS. 1-2, according to one or more embodiments. FIGS. 2-3 are discussed below concurrently. The coiled tubing injector 108 is an example coiled tubing injector generally representative of various coiled tubing injectors. For example, the coiled tubing injector 108 can include any of the components or features described in U.S. Pat. Nos. 8,544,536, 8,701,754, or U.S. Pat. No. 10,024,123, each of which is hereby incorporated by reference in its entirety.

As shown in FIG. 2, the coiled tubing injector 108 can include two or more drive chains 114, such as a first drive chain 116 (FIG. 2) and a second drive chain 118 (FIG. 2). The first drive chain 116 and the second drive chain 118 can each form a continuous loop. The coiled tubing injector 108 can include a drive system 120 (FIG. 2) for turning or otherwise rotating the first drive chain 116 and the second drive chain 118. For example, the drive system 120 can include a first drive sprocket 122 (FIG. 2), a first idler sprocket 124 (shown in shadow in FIG. 3), a second drive sprocket 126 (FIG. 2), and a second idler sprocket 128 (shown in shadow in FIG. 3). The first drive chain 116 can concurrently engage a first drive sprocket 122 and a first idler sprocket 124; and the second drive chain 118 can concurrently engage a second drive sprocket 126 and a second idler sprocket 128.

The first drive sprocket 122 can be connected to a first driveshaft 230 (represented in FIG. 4), the second drive sprocket 126 can be connected to a second driveshaft (represented in FIG. 4), the first idler sprocket 124 can be connected to a first idler shaft 134 (FIG. 2), and the second idler sprocket can be connected to a second idler shaft 136 (FIG. 2). In FIG. 2, a top surface 125 of the coiled tubing injector 108 is partially cut away to reveal the first drive sprocket 122 and the second drive sprocket 126. In some examples, the first driveshaft 230, the second driveshaft 232, the first idler shaft 134, and the second idler shaft 136 can extend parallel to, and laterally offset from, one another to enable the first drive sprocket 122, the first idler sprocket 124, the second drive sprocket 126, and the second idler sprocket 128 to be laterally opposed within a common plane.

The drive system 120 can include at least one hydraulic motor. For example, as shown in FIG. 2, the drive system 120 can include a first hydraulic motor 140 and a second hydraulic motor 142. The first hydraulic motor 140 and the second hydraulic motor 142 can be fixed displacement motors. The first hydraulic motor 140 and the second hydraulic motor 142 can turn or otherwise rotate the first drive sprocket 122 and the second drive sprocket 126, respectively. For example, the first driveshaft 230 and the second driveshaft 232 can be operably coupled to the first hydraulic motor 140 and the second hydraulic motor 142, respectively, such as through a first gearbox 144 (FIG. 2) and a second gearbox 146 (FIG. 2), respectively. The first hydraulic motor 140 and the second hydraulic motor 142 can be configured to rotate in opposite directions to thereby cause the first drive chain 116 and the second drive chain 118 to counter-rotate relative to each other. The coiled tubing injector 108 can include a first brake 148 (FIG. 2) and a second brake 150 (FIG. 2). The first brake 148 can be operably coupled to the first driveshaft 230 and the second brake 150 can be coupled to the second driveshaft 232. The first drive chain 116 and the second drive chain 118 can each carry a plurality of grippers 152 (FIG. 2) shaped to conform to and at least partially encircle the coiled tubing 106 (FIG. 3) therebetween.

The plurality of grippers 152 can define a grip zone 154 (FIG. 3). The grip zone 154 can be an area between the first drive chain 116 and the second drive chain 118 in which the plurality of grippers 152 are in contact with and at least partially encircle the coiled tubing 106. Although not visible, the coiled tubing injector 108 can include at least two skates, one for each of the first drive chain 116 and the second drive chain 118, and a plurality of hydraulic cylinders for pushing the at least two skates toward each other. The at least two skates move the plurality of grippers 152 within the grip zone 154 toward each other under hydraulic pressure provided by the hydraulic cylinders to thereby cause the plurality of grippers 152 to forcibly engage the coiled tubing 106. Examples of such skates and hydraulic cylinders are shown in U.S. Pat. Nos. 5,309,990 and 5,918,671, which are hereby incorporated by reference in their entirety.

The coiled tubing injector 108 can include a tension system 156 (FIG. 2). The tension system 156 can include the first idler sprocket 124, the second idler sprocket 128, the first idler shaft 134, and the second idler shaft 136. For example, the first idler shaft 134 and the second idler shaft 136 can be moveably connected to a frame 161 (FIG. 2) configured to support various components of the coiled tubing injector 108, such as including, but not limited to, the first driveshaft 230, the second driveshaft 232, the first idler shaft 134, and the second idler shaft 136. The tension system 156 can include at least one hydraulic cylinder, such as a one or more first hydraulic cylinders 158 and the one or more second hydraulic cylinders 160.

The one or more first hydraulic cylinders 158 and the one or more second hydraulic cylinders 160 can be arranged within the frame 161 with respect to the first idler shaft 134 and the second idler shaft 136, respectively, such as to enable the one or more first hydraulic cylinders 158 to adjust the distance between the first driveshaft 230 and the first idler shaft 134, and the distance between the second driveshaft 232 and the second idler shaft 136, by translating the first idler shaft 134 and the second idler shaft 136 with respect to the frame 161. The one or more first hydraulic cylinders 158 and the one or more second hydraulic cylinders 160 are thereby operable to place the first drive chain 116 and the second drive chain 118 under constant tension during rotation of the first drive sprocket 122, the first idler sprocket 124, the second drive sprocket 126, and the second idler sprocket 128. The tension system 156 can include a reactive chain tension circuit 262 (FIG. 4).

The reactive chain tension circuit 262 can be configured to automatically adjust the fluid pressure within the one or more first hydraulic cylinders 158 and the one or more second hydraulic cylinders 160, and thereby automatically tension the first drive chain 116 and the second drive chain 118. For example, the reactive chain tension circuit 262 can be in fluid communication with the first hydraulic motor 140 and/or the second hydraulic motor 142 to receive a pressure signal indicative of a positive or a negative tubing load on the coiled tubing injector 108. That is, the first hydraulic motor 140 and the second hydraulic motor 142 can be the primary motive element driving the coiled tubing 106, and the amount of power used (in the form of hydraulic pressure) to advance or withdraw the coiled tubing 106 into, or out of, a wellbore is related to the upward or downward force on the coiled tubing 106. The reactive chain tension circuit 262 can then use the pressure signal to increase or decrease the fluid pressure within the one or more first hydraulic cylinders 158 and the one or more second hydraulic cylinders 160 to maintain a pressure differential between the fluid pressure within the first hydraulic motor 140 and the second hydraulic motor 142 and the fluid pressure within the one or more first hydraulic cylinders 158 and the one or more second hydraulic cylinders 160.

Such a pressure differential can include a first pressure threshold and a second pressure threshold. In one example, the first pressure threshold can be a minimum pressure, based on a tubing load on the coiled tubing injector 108, selected to prevent bunching of the first drive chain 116 and the second drive chain 118; and the second pressure threshold can be a maximum pressure, based on a tubing load on the coiled tubing injector 108, before which the first drive chain 116 and the second drive chain 118 experience excessive tension. In view of the above, the tension system 256 can automatically tension the first drive chain 116 and the second drive chain 118 based on a tubing load on the coiled tubing injector 108.

Figure 4:
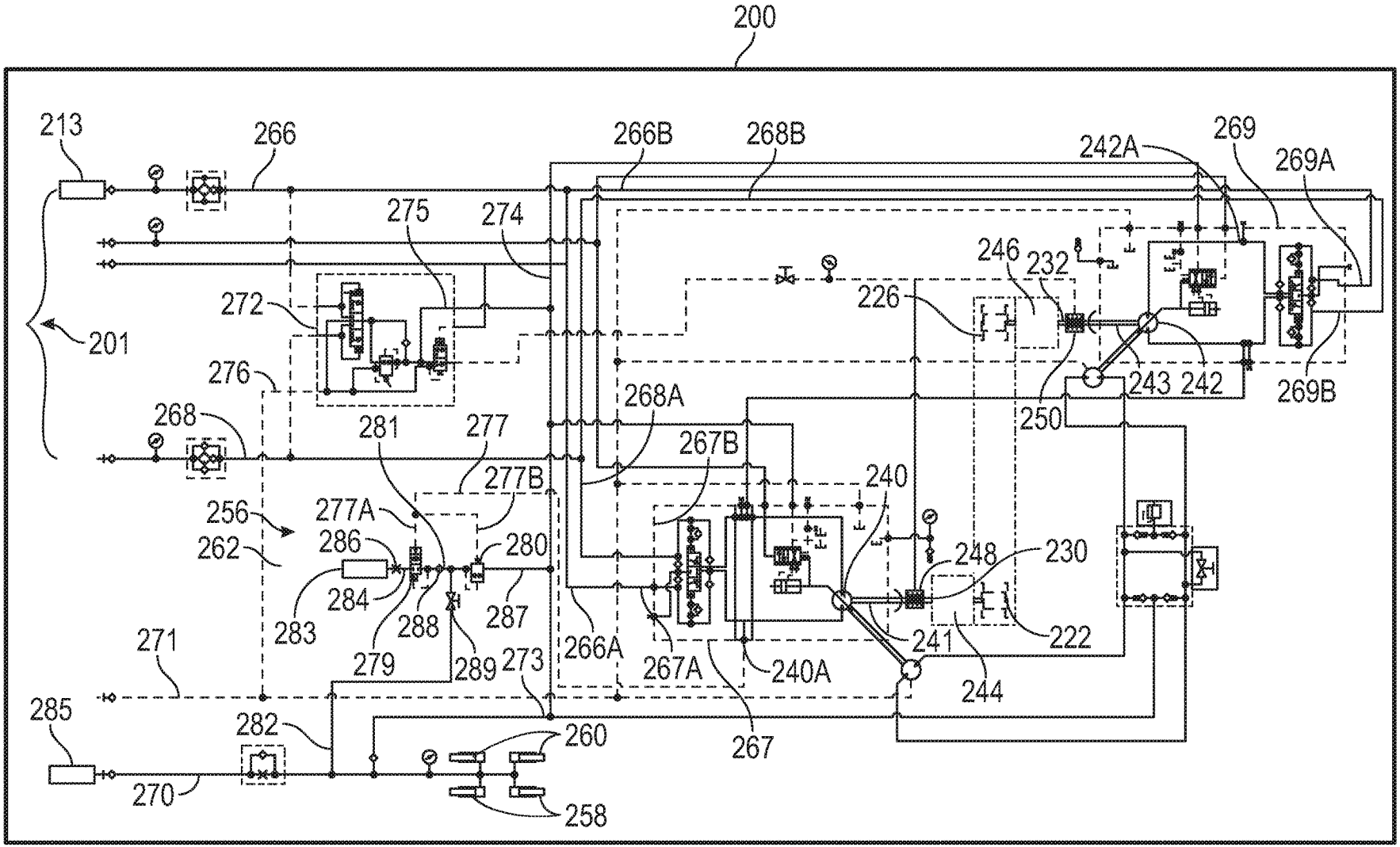
FIG. 4 illustrates a hydraulic circuit of the coiled tubing injector of FIGS. 1-3 including an example reactive chain tension circuit, according to one or more examples.

FIG. 4 illustrates a hydraulic circuit of the coiled tubing injector of FIGS. 1-3 including an example reactive chain tension circuit 262, according to one or more embodiments. In FIG. 4, the power pack 113, the first drive sprocket 122, the second drive sprocket 126, the first hydraulic motor 140, the second hydraulic motor 142, the first brake 148, the second brake 150, the one or more first hydraulic cylinders 158, and the one or more second hydraulic cylinders 160 shown in FIG. 2 are discussed with regard to reference numbers 213, 222, 226, 248, 250, 258, and 260, respectively. The hydraulic circuit 200 is one example of a simplified hydraulic circuit that can be used with the coiled tubing injector 108 shown in FIGS. 1-3 above. The hydraulic circuit 200 can include a drive circuit 201, such as formed by a drive line 266 and a return line 268. The drive line 266 and the return line 268 can be configured for connection to the power pack 213, such as to supply the hydraulic circuit 200 with pressurized hydraulic fluid at a preset or charge pressure. Fluid pressure within the drive line 266 can change in response to a negative tubing load on the coiled tubing injector 108, and fluid pressure within the return line 268 can change in response to a positive tubing load on the coiled tubing injector 108.

The first hydraulic motor 240 can be connected to the drive line 266 through branch 266A, such as via port 267A of a first counterbalance valve 267. The second hydraulic motor 242 can be connected to the drive line 266 through branch 266B, such as via port 269A of a second counterbalance valve 269. The first hydraulic motor 240 can be connected to the return line 268 through branch 268A, such as via port 267B of the first counterbalance valve 267. The second hydraulic motor 242 can be connected to the return line 268 through branch 268B, such as via port 269B of the second counterbalance valve 269. The first counterbalance valve 267 and the second counterbalance valve 269 can be configured to regulate the flow of hydraulic fluid through the first hydraulic motor 240 and the second hydraulic motor 242, respectively. For example, the first counterbalance valve 267 and the second counterbalance valve 269 can be operable to start, stop, or otherwise control the speed of the first hydraulic motor 240 and the second hydraulic motor 242, respectively.

The first hydraulic motor 240 can include a shaft 241 connected to the first brake 248 and the first gearbox 244, which can in turn rotate the first drive sprocket 222 via an output shaft. The second hydraulic motor 242 can include a shaft 243 connected to the second brake 250 and the second gearbox 246, which can in turn rotate the second drive sprocket 226. The tension system 156 (FIG. 1) can include a cylinder drive line 270 and an external fluid source 285. The cylinder drive line 270 can be connected directly to the one or more first hydraulic cylinders 258 and the one or more second hydraulic cylinders 260. In one example, such as shown in FIG. 4, the one or more first hydraulic cylinders 258 and the one or more second hydraulic cylinders 260 each include two hydraulic cylinders. The cylinder drive line 270 can be connected to the external fluid source 285. The external fluid source 285 can supply pressurized hydraulic fluid to cylinder drive line 270. Fluid pressure within the cylinder drive line 270 can dictate the amount of tension within the first drive chain 116 (FIG. 2) and the second drive chain 118 (FIG. 2). Pressurized hydraulic fluid within the cylinder drive line 270 can be discharged to a drain line 271 through a brake manifold assembly 272 for controlling the first brake 248 and the second brake 250, such as through lines 273, 274, 275, and 276.

A user can manually adjust the fluid pressure within the cylinder drive line 270, such as via one or more user inputs to the external fluid source 285. For example, a user can increase or decrease the fluid pressure within the cylinder drive line 270 to a limit (e.g., a first pressure threshold or a second pressure threshold) implemented by the reactive chain tension circuit 262. The reactive chain tension circuit 262 can include a pilot line 277. The pilot line 277 can be in fluid communication with the drive line 266. For example, the pilot line 277 can be connected to a first port 240A of the first hydraulic motor 240. The first port 240A can be a port that is in fluid communication with the drive line 266, at least in that fluid pressure at the first port 240A can be equal to the fluid pressure within the drive line 266. In other examples, the pilot line 277 can be connected directly to the drive line 266, or to a first port 242A of the second hydraulic motor 242.

The reactive chain tension circuit 262 can include a first valve 279 and a second valve 280. The first valve 279 and the second valve 280 can be connected to the pilot line 277 in parallel, such as through branch 277A and branch 277B, respectively. The pilot line 277 can thereby provide a pressure signal indicative of a tubing load on the coiled tubing injector 108 to the reactive chain tension circuit 262. The first valve 279 and the second valve 280 can be, for example, but not limited to, pilot-operated pressure control valves. The reactive chain tension circuit 262 can include an intermediary line 281 and a tension line 282. The first valve 279 can be connected to the second valve 280 through the intermediary line 281. The tension line 282 can be connected to the cylinder drive line 270. The intermediary line 281 can be connected to the tension line 282, and thereby the one or more first hydraulic cylinders 258 and the one or more second hydraulic cylinders 260, through the tension line 282.

The reactive chain tension circuit 262 can include an auxiliary fluid source 283 and an auxiliary line 284. The auxiliary fluid source 283 can be connected to the first valve 279 through the auxiliary line 284. In some examples, the auxiliary line 284 can include an adjustable orifice 286. The adjustable orifice 286 can be operable to control a fluid flow rate between the auxiliary fluid source 283 and the first valve 279. In one example, the first valve 279 can be configured to maintain the fluid pressure within the one or more first hydraulic cylinders 258 and the one or more second hydraulic cylinders 260 above a first pressure threshold. The first pressure threshold can be a relative fluid pressure set at a fixed interval above, or below, the pressure signal within the pilot line 277, such as selected to meet the unique requirements of an individual coiled tubing injector. In one example, the first pressure threshold can be a pressure about 100 pounds per square inch greater than the pressure signal (e.g., the fluid pressure within the pilot line 277) provided by the branch 277A to the first valve 279.

The first valve 279 can be controlled by the pressure signal provided by the branch 277A of the pilot line 277. For example, when the fluid pressure within the one or more first hydraulic cylinders 258 and the one or more second hydraulic cylinders 260 is less than the first pressure threshold, the first valve 279 can open to enable fluid from the auxiliary fluid source 283 to flow through the first valve 279 until the fluid pressure within the one or more first hydraulic cylinders 258 and the one or more second hydraulic cylinders 260 is equal to the first pressure threshold. Once the fluid pressure within the tension line 282 is equal to the first pressure threshold, the first valve 279 can close to prevent fluid from the auxiliary fluid source 283 from flowing through the first valve 279, such as until the pressure signal within the pilot line 277 indicates the pressure within the tension line 282 is below the first pressure threshold. In view of the above the first valve 279 can selectively connect the auxiliary fluid source 283 to the one or more first hydraulic cylinders 258 and the one or more second hydraulic cylinders 260 based on the pressure signal from the pilot line 277.

The reactive chain tension circuit 262 can include a discharge line 287. The discharge line 287 can be connected to the drain line 271 via the brake manifold assembly 272, such as through lines 274, 275, and 276. The second valve 280 can be configured to maintain the fluid pressure within the one or more first hydraulic cylinders 258 and the one or more second hydraulic cylinders 260 below a second pressure threshold. The second pressure threshold can be a relative fluid pressure set at a fixed interval above, or below, the pressure signal within the pilot line 277, such as selected to meet the unique requirements an individual coiled tubing injector. In one non-limiting example, the second pressure threshold can be a pressure about 400 pounds per square inch greater than the pressure signal (e.g., the fluid pressure within the pilot line 277) provided by the branch 277B to the second valve 280. The second valve 280 can be controlled by the pressure signal provided by the branch 277B of the pilot line 277.

For example, when the fluid pressure within the one or more first hydraulic cylinders 258 and the one or more second hydraulic cylinders 260 is equal to the second pressure threshold, the second valve 280 can open to enable fluid to flow through the second valve 280 into the discharge line 287 until the fluid pressure within the tension line 282 is below the second pressure threshold. Once the fluid pressure within the tension line 282 is below the second pressure threshold, the second valve 280 can close to prevent fluid from flowing through the second valve 280 until the pressure signal within the pilot line 277 is below the second pressure threshold. In view of the above, the second valve 280 can selectively connect the tension line 282 to the discharge line 287 based on the pressure signal from the pilot line 277.

In some examples, the intermediary line 281 can include a directional control valve 288. The directional control valve 288 can be, but is not limited to, a check valve. The directional control valve 288 can be configured to prevent fluid flow from the tension line 282 to the first valve 279, such as to help reduce pressure leakage associated with the one or more first hydraulic cylinders 258 and the one or more second hydraulic cylinders 260. For example, the directional control valve 288 can be located on the intermediary line 281 downstream of the first valve 279, such as between the first valve 279 and a point at which the intermediary line 281 is connected to the tension line 282. In some examples, the reactive chain tension circuit 262 can include a two-way valve 289. The two-way valve 289 can be, for example, but is not limited, to a manually operable ball valve. The two-way valve 289 can be opened by a user to operably connect, or disconnect, the reactive chain tension circuit 262 to the one or more first hydraulic cylinders 258 and the one or more second hydraulic cylinders 260 by enabling or preventing fluid flow through the tension line 282.

Figure 5:
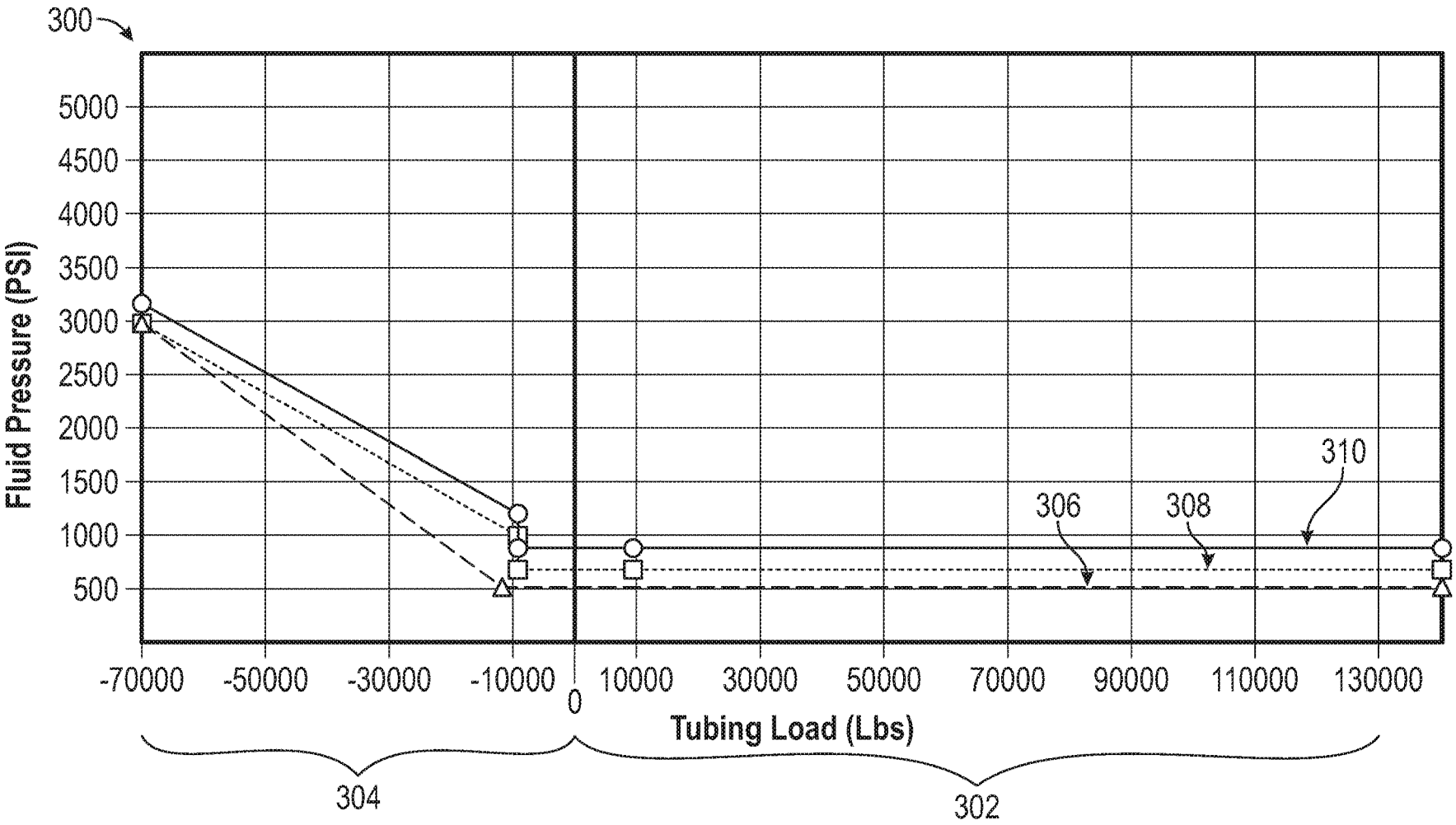
FIG. 5 illustrates an example graph illustrating fluid pressure with the reactive chain tension circuit of FIG. 4 as a function of tubing load on the coiled tubing injector of FIGS. 1-3, according to one or more examples.

FIG. 5 is an example graph 300 illustrating hydraulic fluid pressure with the reactive chain tension circuit 262 of FIG. 4 as a function of tubing load of the coiled tubing injector of FIGS. 1-3. Section 302 of the graph 300 can represent a period where the coiled tubing injector 108 is experiencing a positive tubing load, in pounds. A positive tubing load can indicate the coiled tubing 106 is in a pipe-heavy state; and the first hydraulic motor 240 (FIG. 4) and the second hydraulic motor 242 (FIG. 4) are working to resist a downward force of gravity acting on the coiled tubing 106. Section 304 of the graph 300 can represent a period where the coiled tubing injector 108 is experiencing a negative tubing load, in pounds. A negative tubing load can indicate that the coiled tubing is in a pipe-light state; and the first hydraulic motor 240 and the second hydraulic motor 242 are working to overcome an upward force acting on the coiled tubing 106, such as from within a wellbore.

A line 306 can represent an example minimum pressure within the one or more first hydraulic cylinders 258 (FIG. 4) and the one or more second hydraulic cylinders 260 (FIG. 4) relative to a tubing load, such as necessary or recommended to prevent chain bunching. Traditionally, this minimum pressure is maintained by a user, such as by manually increasing or decreasing the fluid pressure within the one or more first hydraulic cylinders 258 (FIG. 4) and the one or more second hydraulic cylinders 260 using the external fluid source 285 (FIG. 4) A line 308 can represent action, in the form of a pressure curve, of the first valve 279 (FIG. 4) in response to the pressure signal provided by the pilot line 277 (FIG. 4). The first pressure threshold is shown by the line 308 as 100 pounds per square inch above the pressure signal provided by the pilot line 277. A line 310 can represent action, in the form of a pressure curve, of the second valve 280 (FIG. 4) in response to the pressure signal provided by the pilot line 277. The second pressure threshold is shown by the line 310 as 400 pounds per square inch above the pressure signal provided by the pilot line 277.

The first valve 279 can maintain the fluid pressure within the reactive chain tension circuit 262, and thereby the one or more first hydraulic cylinders 258 and the one or more second hydraulic cylinders 260, above the line 306 (e.g., the minimum pressure) and the minimum pressure threshold when the coiled tubing injector 108 is experiencing a positive load. For example, the fluid pressure within the pilot line 277 will not increase above a charge pressure (illustrated in FIG. 5 as 500 pounds per square inch) provided by the power pack 213 (FIG. 4) of the drive circuit 201, as only the fluid pressure within the return line 268 will increase when the coiled tubing injector 108 is experiencing a positive tubing load. As such, in section 302, the first valve 279 will generally be in a closed state to continuously maintain the fluid pressure within the one or more first hydraulic cylinders 258 and the one or more second hydraulic cylinders 260 above the line 306.

The first valve 279 can maintain the fluid pressure within the reactive chain tension circuit 262, and thereby the one or more first hydraulic cylinders 258 and the one or more second hydraulic cylinders 260, above the line 306 (e.g., the minimum pressure) and the minimum pressure threshold when the coiled tubing injector 108 is experiencing a negative load. For example, as the fluid pressure within the pilot line 277 will increase in response to an increasing negative tubing load on the coiled tubing injector 108, the first valve 279 will open to enable fluid from the auxiliary fluid source 283 (FIG. 4) to flow through the first valve 279 until the fluid pressure within the one or more first hydraulic cylinders 258 and the one or more second hydraulic cylinders 260 is equal to the first pressure threshold. As such, in section 304, the first valve 279 will generally alternate between an open state and a closed state to continuously maintain the fluid pressure within the one or more first hydraulic cylinders 258 and the one or more second hydraulic cylinders 260 above the pressure signal provided by the pilot line 277.

The second valve 280 can maintain the fluid pressure within the reactive chain tension circuit 262, and thereby the one or more first hydraulic cylinders 258 and the one or more second hydraulic cylinders 260, below a second pressure threshold. For example, when the fluid pressure within the pilot line 277 decreases in response to a decreasing negative tubing load on the coiled tubing injector 108, the second valve 280 can open to enable fluid from the reactive chain tension circuit 262 to flow through the second valve 280 until the fluid pressure within the one or more first hydraulic cylinders 258 and the one or more second hydraulic cylinders 260 is less than the second pressure threshold.

Additionally, during section 302 or section 304, a user can operate the external fluid source 285 to manually increase the fluid pressure within the one or more first hydraulic cylinders 258 and the one or more second hydraulic cylinders 260 up to the second pressure threshold. Upon the occurrence of such an event, the second valve 280 can open to discharge pressure through the discharge line 287 (FIG. 4) until the pressure signal provided to the second valve 280 by the pilot line 277 falls below the second pressure threshold. Additionally, during section 302 or section 304, a user can operate the external fluid source 285 to manually decrease the fluid pressure within the one or more first hydraulic cylinders 258 and the one or more second hydraulic cylinders 260 to first second pressure threshold. Upon the occurrence of such an event, the first valve 279 can open to enable fluid from the auxiliary fluid source 283 (FIG. 4) to flow through the first valve 279 until the fluid pressure within the one or more first hydraulic cylinders 258 and the one or more second hydraulic cylinders 260 is again equal to the first pressure threshold.

Figure 6:
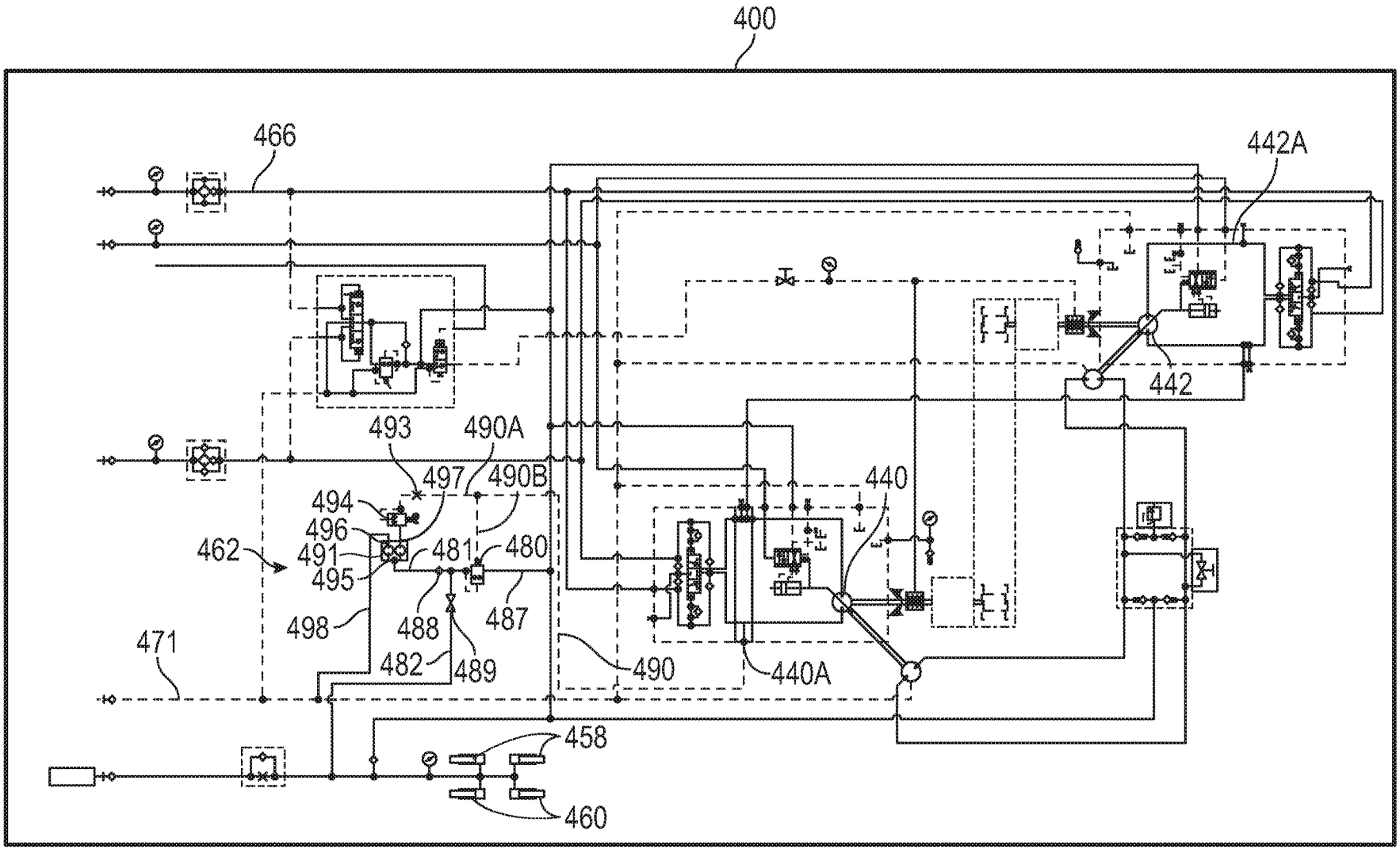
FIG. 6 illustrates a hydraulic circuit of a coiled tubing injector of the coiled tubing injector of FIGS. 1-3 including an example reactive chain tension circuit, according to one or more examples.

FIG. 6 illustrates a hydraulic circuit 400 of the coiled tubing injector 108 of FIGS. 1-3 including an example reactive chain tension circuit 462, according to one or more examples. In FIG. 6, the first hydraulic motor 240, the first port 240A, the second hydraulic motor 242, the port 242A, the one or more first hydraulic cylinders 258, the one or more second hydraulic cylinders 260, the drive line 266, the drain line 271, the second valve 280, the intermediary line 481, the tension line 482, the discharge line 487, the directional control valve 488, and the two-way valve 489 are discussed with regard to reference numbers 440, 440A, 442, 442A, 458, 460, 466, 471, 480, 481, 482, 487, 488, and 489, respectively. The hydraulic circuit 400 is one example of a simplified hydraulic circuit that can be used with the coiled tubing injector 108 shown in FIGS. 1-3 above. The hydraulic circuit 400 can be similar to the hydraulic circuit 200 discussed with regard to FIG. 4 above, except in that the reactive chain tension circuit 462 can be realized using a different combination of components. The reactive chain tension circuit 462 can include a pilot line 490, a flow divider 491, the second valve 480, the intermediary line 481, the tension line 482, and the discharge line 487.

The pilot line 490 can be in fluid communication with the drive line 466. For example, the pilot line 490 can be connected to a first port 440A of the first hydraulic motor 440. The first port 440A can be a port that is in fluid communication with the drive line 466, at least in that fluid pressure at the first port 440A can be equal to the fluid pressure within the drive line 466. In other examples, the pilot line 490 can be connected directly to the drive line 466, or to a first port 442A of the second hydraulic motor 442. The flow divider 491 and the second valve 480 can be connected to the pilot line 490 in parallel, such as through branch 490A and branch 490B, respectively. The pilot line 490 can thereby provide a pressure signal indicative of a tubing load on the coiled tubing injector 108 to the reactive chain tension circuit 462. The second valve 480 can be connected to the flow divider 491 through the intermediary line 481.

In some examples, the branch 490A of the pilot line 490 can include an adjustable orifice 493. The adjustable orifice 493 can be operable to control a fluid flow rate between the first hydraulic motor 440 and the flow divider 491. For example, the adjustable orifice 493 can be located on branch 490A of the pilot line 490. In some examples, the pilot line 490 can include a pressure reducing valve 494. The pressure reducing valve 494 can be configured to limit a maximum fluid pressure at the flow divider 491 and the second valve 480. The flow divider 491 can include a first port 495, a second port 496, and a third port 497. In one example, the flow divider 491 can be configured to maintain the fluid pressure within the one or more first hydraulic cylinders 458 and the one or more second hydraulic cylinders 460 above a first pressure threshold. For example, the flow divider 491 can be configured as a pressure intensifier. In such an example, the first port 495 can be connected to the branch 490A of the pilot line 490, the second port 496 can be connected to the drain line 471 through a flow line 498, and the third port 497 can be connected to the second valve 480 via the intermediary line 481.

In operation, fluid pressure at the third port 497, and the thereby the tension line 482, the one or more first hydraulic cylinders 458, and the one or more second hydraulic cylinders 460, will be proportionally greater than the fluid pressure at the first port 495 and the pilot line 490 by the amount of fluid pressure that the second port 496 and the flow line 498 direct to the drain line 471. For example, if the flow divider 491 is has a two-to-one ratio between the third port 497 and the second port 496, the second port 496 can divert one-third of the fluid pressure at the first port 495, and therefore the fluid pressure within the one or more first hydraulic cylinders 458 and the one or more second hydraulic cylinders 460 will be one-third greater than the fluid pressure within the pilot line 490. In this way, the flow divider 491 can maintain the fluid pressure within the one or more first hydraulic cylinders 458 and the one or more second hydraulic cylinders 460 above a first pressure threshold, such as when the first pressure threshold is a pressure greater than the fluid pressure within the first hydraulic motor 240 and the drive line 466.

In other examples, the flow divider 491 can be configured as a pressure reducer. In such an example, such as shown in FIG. 4, the first port 495 can be connected to the second valve 480 via the intermediary line 481, the second port 496 can be connected to the flow line 498, and the third port 497 can be connected the branch 490A of the pilot line 490. In operation, fluid pressure at the first port 495, and the thereby the tension line 482, the one or more first hydraulic cylinders 458, and the one or more second hydraulic cylinders 460, will be proportionally less than the amount of fluid pressure at the third port 497 and the pilot line 490 by the amount of the fluid pressure that the second port 496 and the flow line 498 bring into the flow divider 491 from the drain line 471.

For example, if the flow divider 491 has a two-to-one ratio between the third port 497 and the second port 496, and the second port 496 contributes zero, or otherwise a nominal, fluid pressure to the second port 496, the fluid pressure within the one or more first hydraulic cylinders 458 and the one or more second hydraulic cylinders 460 will be one-third less than the fluid pressure within the pilot line 490. In this way, the flow divider 491 can maintain the fluid pressure within the one or more first hydraulic cylinders 458 and the one or more second hydraulic cylinders 460 above a first pressure threshold, such as when the first pressure threshold is a pressure less than the fluid pressure within the first hydraulic motor 440 and the drive line 466.

The flow divider 491 can help the reactive chain tension circuit 462 meet the unique requirements of different coiled tubing injectors. For example, the flow divider 491 can be selected based on various components of a coiled tubing injector, such as to help ensure that a pressure curve defined by fluid flow through the flow divider 491 can closely correspond to a minimum pressure within the one or more first hydraulic cylinders 458 and the one or more second hydraulic cylinders 460 relative to a tubing load on the coiled tubing injector. In one such example, the flow divider 491 can be selected to control fluid flow within the reactive chain tension circuit 462 such that the line 308 (FIG. 5) and the line 310 (FIG. 5) shown in section 304 (FIG. 5) of the graph 300 (FIG. 5) extend parallel to, and laterally offset from, the line 306 (e.g., the minimum pressure).

Figure 7:
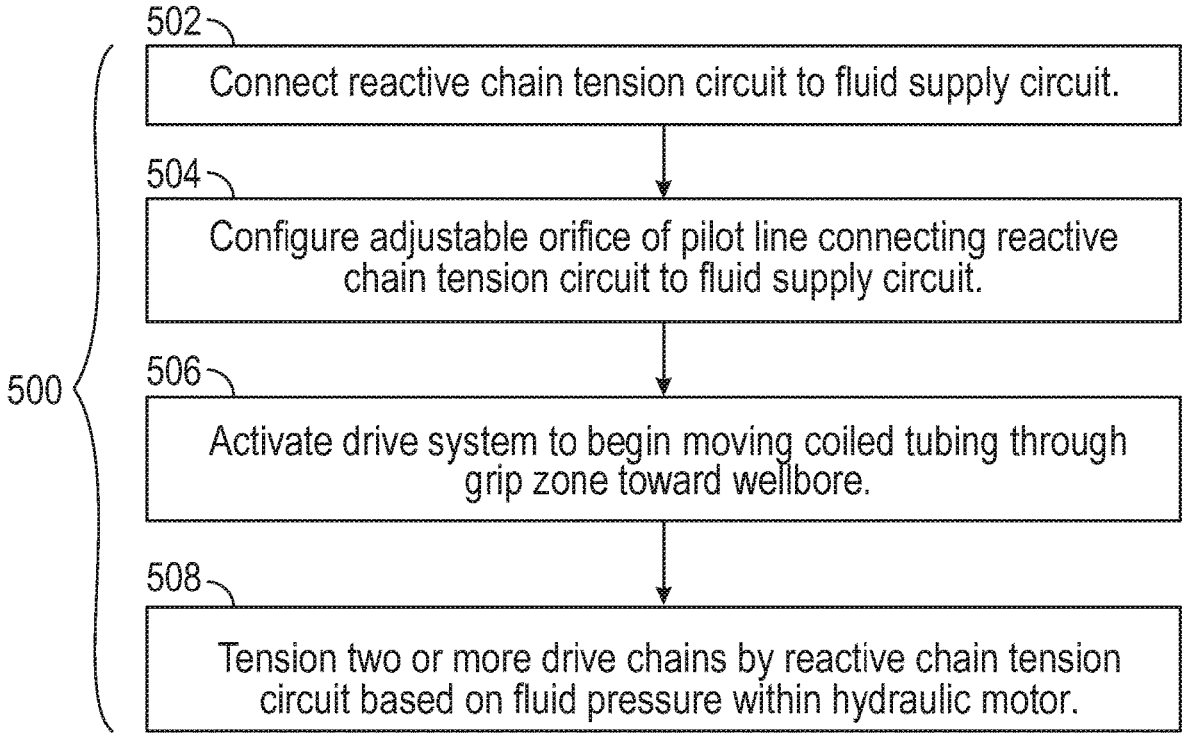
FIG. 7 illustrates a method of using a coiled tubing injector, according to one or more examples.

FIG. 7 illustrates an example method 500 of using a coiled tubing injector. Any of the above examples of the coiled tubing injector 108, and the reactive chain tension circuits 262 and 462, described with regard to FIGS. 1-5 above can be used in the method 500 of using a coiled tubing injector. The discussed steps or operations can be performed in parallel or in a different sequence without materially impacting other operations. The method 500 as discussed includes operations that can be performed by multiple different actors, devices, and/or systems. It is understood that subsets of the operations discussed in the method 500 can be attributable to a single actor device, or system, and could be considered a separate standalone process or method.

The method 500 can optionally include operation 502. The operation 502 can include connecting the reactive chain tension circuit to the at least one hydraulic motor. For example, a user can open a two-way valve to operably connect the reactive chain tension circuit to the at least one hydraulic cylinder to thereby enable fluid flow through the reactive chain tension circuit to the at least one hydraulic cylinder. The method operation can optionally include operation 504. The operation 504 can include adjusting an orifice between the reactive chain tension circuit and the drive line. For example, a user can engage an adjustable orifice to set or otherwise adjust a fluid flow rate between the at least one hydraulic motor and the reactive chain tension circuit.

The method 500 can include operation 506. The operation 506 can include activating the drive system to begin moving the coiled tubing through the grip zone toward a wellbore. For example, a user can engage with, such as via one or more user inputs to, a hydraulic power pack or power unit to charge the drive line and a return connected to the at least one hydraulic motor to enable the at least one hydraulic motor to begin turning the two or more drive chains carrying the plurality of grippers.

The method can include operation 508. The operation 508 can include tensioning the two or more drive chains by a reactive chain tension circuit based on a fluid pressure within the at least one hydraulic motor, by maintaining a pressure differential between the fluid pressure within the at least one hydraulic motor and a fluid pressure within at least one hydraulic cylinder for tensioning the at least two drive chains. For example, when the drive system begins moving the coiled tubing through the grip zone, the reactive chain tension circuit can receive a pressure signal from the at least one hydraulic motor indicative of a tubing load on the coiled tubing injector to enable the reactive tension circuit to automatically adjust the tension within the first drive chain and the second drive chain based on the tubing load, such as by maintaining the fluid pressure within the at least one hydraulic cylinder at a set or otherwise fixed interval above or below the pressure signal.

In some examples, the operation 508 can include actuating a first valve to maintain a fluid pressure within the hydraulic reactive tension circuit above a first pressure threshold. For example, when the fluid pressure within the reactive chain tension circuit, and thereby the at least one hydraulic cylinder, is less than the first pressure threshold, the first valve can open to enable fluid, such as from an external fluid source, to flow through the first valve until the fluid pressure within the at least one hydraulic cylinder is equal to the first pressure threshold. In some examples, the operation 508 can include actuating a second valve to maintain the fluid pressure within the hydraulic reactive tension circuit below a second pressure threshold. For example, when the fluid pressure within the reactive chain tension circuit, and thereby the at least one hydraulic cylinder, is equal to the second pressure threshold, the second valve can open to enable fluid to flow through the second valve to a drain line until the fluid pressure within the at least one hydraulic cylinder is below the second pressure threshold.

In some examples, the operation 508 can include directing hydraulic fluid through a flow divider to maintain a fluid pressure within the hydraulic reactive tension circuit above a first pressure threshold. For example, the flow divider can be configured as a pressure intensifier, and fluid within the pilot line at the pressure within the drive line and the least one hydraulic motor can be passed through the flow divider to increase the fluid pressure by an amount equal to or greater than the first pressure threshold.

The foregoing systems and devices, etc. are merely illustrative of the components, interconnections, communications, functions, etc. that can be employed in carrying out examples in accordance with this disclosure. Different types and combinations of sensor or other portable electronics devices, computers including clients and servers, implants, and other systems and devices can be employed in examples according to this disclosure.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventor also contemplates examples in which only those elements shown or described are provided.

Moreover, the present inventor also contemplates examples using any combination or permutation of those elements shown or described (or one or more aspects thereof), either with respect to a particular example (or one or more aspects thereof), or with respect to other examples (or one or more aspects thereof) shown or described herein. In the event of inconsistent usages between this document and any documents so incorporated by reference, the usage in this document controls.

In this document, the terms "a" or "an" are used, as is common in patent documents, to include one or more than one, independent of any other instances or usages of"at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure.

This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

EXAMPLES

The following, non-limiting examples, detail certain aspects of the present subject matter to solve the challenges and provide the benefits discussed herein, among others.

Example 1 is a coiled tubing injector comprising: two or more drive chains each forming a continuous loop and carrying a plurality of grippers for engaging coiled tubing within a grip zone defined between the two or more drive chains; a drive system including: a first drive sprocket engaged with a first drive chain of the two or more drive chains; a second drive sprocket engaged with a second drive chain of the two or more drive chains; at least one hydraulic motor for turning the first drive sprocket and the second drive sprocket, the at least one hydraulic motor connected to a drive line and a return line forming a drive circuit for fluidly powering the at least one hydraulic motor; and a tension system including: at least one hydraulic cylinder for tensioning the two or more drive chains, and a reactive chain tension circuit for automatically tensioning the two or more drive chains by maintaining a pressure differential between a fluid pressure within the drive line and a fluid pressure within the at least one hydraulic cylinder.

In Example 2, the subject matter of Example 1 includes, where the reactive chain tension circuit includes a first valve configured to maintain the fluid pressure within the at least one hydraulic cylinder above a first pressure threshold; and a second valve configured to maintain the fluid pressure within the at least one hydraulic cylinder below a second pressure threshold.

In Example 3, the subject matter of Example 2 includes, wherein the reactive chain tension circuit includes a pilot line connecting the first valve and the second valve in parallel to the drive line to provide the first valve and the second valve with a pressure signal indicative of a tubing load on the coiled tubing injector.

In Example 4, the subject matter of Example 3 includes, wherein the at least one hydraulic motor includes a first port in fluid communication with the drive line and the pilot line of the reactive chain tension circuit.

In Example 5, the subject matter of Example 4 includes, wherein the tension system includes an auxiliary fluid source; and wherein the first valve is configured to maintain the fluid pressure within the at least one hydraulic cylinder above the first pressure threshold by selectively connecting the auxiliary fluid source to the at least one hydraulic cylinder based on the pressure signal.

In Example 6, the subject matter of Example 5 includes, wherein the first valve is connected to the auxiliary fluid source with an auxiliary line including an adjustable orifice operable to control a fluid flow rate between the auxiliary fluid source and the reactive chain tension circuit.

In Example 7, the subject matter of Examples 5-6 includes, wherein the first valve and the second valve are connected to the reactive chain tension circuit by a tension line, the tension line including a two-way valve operable to disconnect the reactive chain tension circuit from the tension system.

In Example 8, the subject matter of Example 7 includes, wherein the first valve and the second valve are connected to each other via an intermediary line extending therebetween, the intermediary line including a directional control valve positioned to prevent fluid flow from the tension line to the first valve to reduce leakage associated with the at least one hydraulic cylinder, and wherein the tension line is connected to the intermediary line between the directional control valve and the second valve.

In Example 9, the subject matter of Example 8 includes, wherein the second valve is configured to maintain the fluid pressure within the at least one hydraulic cylinder below the second pressure threshold by selectively connecting the tension line to a discharge line.

In Example 10, the subject matter of Example 9 includes, an external fluid source connected to the at least one hydraulic cylinder, wherein the external fluid source is manually operable to increase the fluid pressure within the at least one hydraulic cylinder to the second pressure threshold or decrease the fluid pressure within the at least one hydraulic cylinder to the first pressure threshold.

Example 11 is a coiled tubing injector comprising two or more drive chains each forming a continuous loop and carrying a plurality of grippers for engaging coiled tubing within a grip zone defined between the two or more drive chains; a drive system including: a first drive sprocket engaged with a first drive chain of the two or more drive chains; a second drive sprocket engaged with a second drive chain of the two or more drive chains; a first hydraulic motor for turning the first drive sprocket; a second hydraulic motor for turning the second drive sprocket, wherein the first hydraulic motor and the second hydraulic motor are connected in parallel to a drive line and a return line forming a drive circuit for fluidly powering the first hydraulic motor and the second hydraulic motor; and a tension system including: one or more first hydraulic cylinders for tensioning the first drive chain; one or more second hydraulic cylinders for tensioning the second drive chain; and a reactive chain tension circuit for automatically tensioning the first drive chain and the second drive chain by maintaining a pressure differential between a fluid pressure within the drive line and a fluid pressure within the first hydraulic cylinder and the second hydraulic cylinder, wherein the reactive chain tension circuit is connected to a first port of the first hydraulic motor via a pilot line to provide the reactive chain tension circuit with a pressure signal indicative of a tubing load on the coiled tubing injector.

In Example 12, the subject matter of Example 11 includes, wherein the reactive chain tension circuit includes: a flow divider configured to maintain the fluid pressure within the first hydraulic cylinder and the second hydraulic cylinder above a first pressure threshold; and a pilot operated pressure control valve configured to maintain the fluid pressure within the first hydraulic cylinder and the second hydraulic cylinder below a second pressure threshold, wherein the pilot line connects the flow divider and the pilot operated pressure control valve to the drive line in parallel.

In Example 13, the subject matter of Example 12 includes, wherein the pilot line includes a pressure reducing valve configured to limit a maximum fluid pressure at the flow divider and the pilot operated pressure control valve.

In Example 14, the subject matter of Example 13 includes, wherein the pilot line includes an adjustable orifice operable to control a fluid flow rate between the first hydraulic motor and the pressure reducing valve; and wherein the reactive chain tension circuit includes a two-way valve operable to disconnect the reactive chain tension circuit from the drive line.

Example 15 is a method of using a coiled tubing injector including two or more drive chains carrying a plurality of grippers for engaging coiled tubing within a grip zone defined between a first drive chain and a second drive chain, and a drive system for turning the two or more drive chains and including at least one hydraulic motor connected to a drive line for fluidly powering the at least one hydraulic motor, the method comprising: activating the drive system to begin moving the coiled tubing through the grip zone toward a wellbore; and tensioning the two or more drive chains by a reactive chain tension circuit based on a fluid pressure within the at least one hydraulic motor, by maintaining a pressure differential between the fluid pressure within the at least one hydraulic motor and a fluid pressure within at least one hydraulic cylinder for tensioning the first drive chain and the second drive chain.

In Example 16, the subject matter of Example 15 includes, wherein tensioning the two or more drive chains by the reactive chain tension circuit includes actuating a first valve to maintain a fluid pressure within the reactive chain tension circuit above a first pressure threshold; and actuating a second valve to maintain the fluid pressure within the reactive chain tension circuit below a second pressure threshold.

In Example 17, the subject matter of Examples 15-16 includes, wherein tensioning the two or more drive chains by the reactive chain tension circuit includes: directing hydraulic fluid through a flow divider to maintain a fluid pressure within the reactive chain tension circuit above a first pressure threshold, and actuating a pilot operated pressure control valve to maintain the fluid pressure within the reactive chain tension circuit below a second threshold pressure.

In Example 18, the subject matter of Example 17 includes, wherein directing hydraulic fluid through a flow divider to increase a fluid pressure within the reactive chain tension circuit to a first threshold pressure includes actuating a pressure reducing valve to limit a fluid pressure at the flow divider and the pilot operated pressure control valve.

In Example 19, the subject matter of Examples 15-18 includes, wherein tensioning the two or more drive chains by the reactive chain tension circuit includes first adjusting an orifice between the reactive chain tension circuit and the drive line.

In Example 20, the subject matter of Examples 15-19 includes, wherein tensioning the two or more drive chains by the reactive chain tension circuit first includes first connecting the reactive chain tension circuit to the at least one hydraulic motor.

Example 21 is at least one machine-readable medium including instructions that, when executed by processing circuitry, cause the processing circuitry to perform operations to implement of any of Examples 1-20.

Example 22 is an apparatus comprising means to implement of any of Examples 1-20.

Example 23 is a system to implement of any of Examples 1-20.

Example 24 is a method to implement of any of Examples 1-20.

What is claimed is:

1. A coiled tubing injector comprising:

two or more drive chains each forming a continuous loop and carrying a plurality of grippers for engaging coiled tubing within a grip zone defined between the two or more drive chains;

a drive system including:

a first drive sprocket engaged with a first drive chain of the two or more drive chains;

a second drive sprocket engaged with a second drive chain of the two or more drive chains;

at least one hydraulic motor for turning the first drive sprocket and the second drive sprocket, the at least one hydraulic motor connected to a drive line and a return line forming a drive circuit for fluidly powering the at least one hydraulic motor; and a tension system including:

at least one hydraulic cylinder for tensioning the two or more drive chains; and a reactive chain tension circuit for automatically tensioning the two or more drive chains by maintaining a pressure differential between a fluid pressure within the drive line and a fluid pressure within the at least one hydraulic cylinder.

2. The coiled tubing injector of claim 1, where the reactive chain tension circuit includes:

a first valve configured to maintain the fluid pressure within the at least one hydraulic cylinder above a first pressure threshold; and a second valve configured to maintain the fluid pressure within the at least one hydraulic cylinder below a second pressure threshold.

3. The coiled tubing injector of claim 2, wherein the reactive chain tension circuit includes a pilot line connecting the first valve and the second valve in parallel to the drive line to provide the first valve and the second valve with a pressure signal indicative of a tubing load on the coiled tubing injector.

4. The coiled tubing injector of claim 3, wherein the at least one hydraulic motor includes a first port in fluid communication with the drive line and the pilot line.

5. The coiled tubing injector of claim 4, wherein the tension system includes an auxiliary fluid source; and wherein the first valve is configured to maintain the fluid pressure within the at least one hydraulic cylinder above the first pressure threshold by selectively connecting the auxiliary fluid source to the at least one hydraulic cylinder based on the pressure signal.

6. The coiled tubing injector of claim 5, wherein the first valve is connected to the auxiliary fluid source with an auxiliary line including an adjustable orifice operable to control a fluid flow rate between the auxiliary fluid source and the reactive chain tension circuit.

7. The coiled tubing injector of claim 5, wherein the first valve and the second valve are connected to the reactive chain tension circuit by a tension line, the tension line including a two-way valve operable to disconnect the reactive chain tension circuit from the tension system.

8. The coiled tubing injector of claim 7, wherein the first valve and the second valve are connected to each other via an intermediary line extending therebetween, the intermediary line including a directional control valve positioned to prevent fluid flow from the tension line to the first valve to reduce leakage associated with the at least one hydraulic cylinder; and wherein the tension line is connected to the intermediary line between the directional control valve and the second valve.

9. The coiled tubing injector of claim 8, wherein the second valve is configured to maintain the fluid pressure within the at least one hydraulic cylinder below the second pressure threshold by selectively connecting the tension line to a discharge line.

10. The coiled tubing injector of claim 9, further comprising an external fluid source connected to the at least one hydraulic cylinder, wherein the external fluid source is manually operable to increase the fluid pressure within the at least one hydraulic cylinder to the second pressure threshold or decrease the fluid pressure within the at least one hydraulic cylinder to the first pressure threshold.

11. A coiled tubing injector comprising:

two or more drive chains each forming a continuous loop and carrying a plurality of grippers for engaging coiled tubing within a grip zone defined between the two or more drive chains;

a drive system including:

a first drive sprocket engaged with a first drive chain of the two or more drive chains;

a second drive sprocket engaged with a second drive chain of the two or more drive chains;

a first hydraulic motor for turning the first drive sprocket;

a second hydraulic motor for turning the second drive sprocket, wherein the first hydraulic motor and the second hydraulic motor are connected in parallel to a drive line and a return line forming a drive circuit for fluidly powering the first hydraulic motor and the second hydraulic motor; and a tension system including:

one or more first hydraulic cylinders for tensioning the first drive chain;

one or more second hydraulic cylinders for tensioning the second drive chain; and a reactive chain tension circuit for automatically tensioning the first drive chain and the second drive chain by maintaining a pressure differential between a fluid pressure within the drive line and a fluid pressure within the first hydraulic cylinder and the second hydraulic cylinder, wherein the reactive chain tension circuit is connected to a first port of the first hydraulic motor via a pilot line to provide the reactive chain tension circuit with a pressure signal indicative of a tubing load on the coiled tubing injector.

12. The coiled tubing injector of claim 11, wherein the reactive chain tension circuit includes:

a flow divider configured to maintain the fluid pressure within the first hydraulic cylinder and the second hydraulic cylinder above a first pressure threshold; and a pilot operated pressure control valve configured to maintain the fluid pressure within the first hydraulic cylinder and the second hydraulic cylinder below a second pressure threshold, wherein the pilot line connects the flow divider and the pilot operated pressure control valve to the drive line in parallel.

13. The coiled tubing injector of claim 12, wherein the pilot line includes a pressure reducing valve configured to limit a maximum fluid pressure at the flow divider and the pilot operated pressure control valve.

14. The coiled tubing injector of claim 13, wherein the pilot line includes an adjustable orifice operable to control a fluid flow rate between the first hydraulic motor and the pressure reducing valve; and wherein the reactive chain tension circuit includes a two-way valve operable to disconnect the reactive chain tension circuit from the drive line.

15. A method of using a coiled tubing injector including two or more drive chains carrying a plurality of grippers for engaging coiled tubing within a grip zone defined between a first drive chain and a second drive chain, and a drive system for turning the two or more drive chains and including at least one hydraulic motor connected to a drive line for fluidly powering the at least one hydraulic motor, the method comprising:

activating the drive system to begin moving the coiled tubing through the grip zone toward a wellbore; and tensioning the two or more drive chains by a reactive chain tension circuit based on a fluid pressure within the at least one hydraulic motor, by maintaining a pressure differential between the fluid pressure within the at least one hydraulic motor and a fluid pressure within at least one hydraulic cylinder for tensioning the first drive chain and the second drive chain.

16. The method of claim 15, wherein tensioning the two or more drive chains by the reactive chain tension circuit includes:

actuating a first valve to maintain a fluid pressure within the reactive chain tension circuit above a first pressure threshold; and actuating a second valve to maintain the fluid pressure within the reactive chain tension circuit below a second pressure threshold.

17. The method of claim 15, wherein tensioning the two or more drive chains by the reactive chain tension circuit includes:

directing hydraulic fluid through a flow divider to maintain a fluid pressure within the reactive chain tension circuit above a first pressure threshold; and actuating a pilot operated pressure control valve to maintain the fluid pressure within the reactive chain tension circuit below a second pressure threshold.

18. The method of claim 17, wherein directing hydraulic fluid through a flow divider to maintain a fluid pressure within the reactive chain tension circuit above a first pressure threshold includes actuating a pressure reducing valve to limit a fluid pressure at the flow divider and the pilot operated pressure control valve.

19. The method of claim 15, wherein tensioning the two or more drive chains by the reactive chain tension circuit includes first adjusting an orifice between the reactive chain tension circuit and the drive line.

20. The method of claim 15, wherein tensioning the two or more drive chains by the reactive chain tension circuit includes first connecting the reactive chain tension circuit to the at least one hydraulic motor.

* * * * *